US005382321A

United States Patent [19]

Fägerlind et al.

[11] Patent Number: 5,382,321

[45] Date of Patent: Jan. 17, 1995

[54] PROCESS FOR THE CONCENTRATION OF SPENT LIQUORS

[75] Inventors: Olof Fägerlind, Föreboda, Sweden; Erik Agren, Esbo, Finland

[73] Assignee: A. Ahlstrom Corporation, Noormarkku, Finland

[21] Appl. No.: 868,497

[22] Filed: Apr. 15, 1992

[51] Int. Cl.[6] ..... B01D 1/26

[52] U.S. Cl. ..... 159/47.3; 159/2.1; 159/16.3; 159/17.1; 159/24.2; 159/DIG. 8; 159/DIG. 10; 162/29; 162/46; 162/47; 202/174

[58] Field of Search ..... 203/88, 71, DIG. 8, 203/49; 202/176, 174; 159/47.3, 2.1, 17.1, DIG. 8, DIG. 10, 16.3, 24.2; 162/47, 29, 46, 68, 63

[56] References Cited

U.S. PATENT DOCUMENTS

| | | | |
|---|---|---|---|
| 2,734,565 | 2/1956 | Lockman | 159/47.3 |
| 3,248,107 | 2/1969 | Backteman | 202/174 |
| 3,261,392 | 6/1966 | Jacoby | 159/17.1 |
| 3,672,960 | 6/1972 | Kays | 203/11 |
| 3,783,095 | 1/1974 | Jafs et al. | 159/47.3 |
| 3,807,479 | 4/1974 | Brannland et al. | 159/47 R |
| 3,926,739 | 12/1975 | Izumi | 159/DIG. 8 |
| 3,941,663 | 3/1976 | Steinbruchel | 159/DIG. 8 |
| 4,002,525 | 1/1977 | Baierl | 159/49 |
| 4,100,016 | 7/1978 | Diebold et al. | 161/16 |
| 4,155,804 | 5/1979 | Edge, Jr. | 159/47.3 |
| 4,216,002 | 8/1980 | Rosenblad | 159/13.3 |
| 4,239,589 | 12/1980 | Elton et al. | 159/47.3 |
| 4,265,701 | 5/1981 | Lankenau | 159/47.3 |
| 4,401,510 | 8/1983 | Olson et al. | 159/47.3 |
| 4,401,514 | 8/1983 | Kanzler et al. | 159/47.3 |
| 4,476,024 | 10/1984 | Cheng | 159/47.3 |
| 4,533,433 | 8/1985 | Pattersson | 159/47.3 |
| 4,755,258 | 7/1988 | Ryham | 202/185.2 |
| 4,756,797 | 7/1988 | Elmore et al. | 159/DIG. 8 |
| 4,764,596 | 8/1988 | Lora et al. | 530/507 |
| 4,789,428 | 12/1988 | Ryham | 202/174 |
| 4,857,146 | 8/1989 | Andersson | 159/2.1 |
| 4,878,535 | 11/1989 | Rosenblad | 159/28.6 |
| 4,929,307 | 5/1990 | Kiiskilä et al. | 159/DIG. 8 |
| 4,953,607 | 9/1990 | Erkki et al. | 159/DIG. 8 |
| 5,089,087 | 2/1992 | Elmore et al. | 159/47.3 |

*Primary Examiner*—Virginia Manoharan
*Attorney, Agent, or Firm*—Nixon & Vanderhye

[57] ABSTRACT

A process and apparatus provide for the evaporation of spent liquors in several stages, and recovery of volatile substances from spent liquors of organic solvent pulping processes. The recovery system for volatiles is integrated with the evaporation of spent liquors. Heating condensation is carried out in each evaporator effect on several heat surfaces separated from each other. Pure water, vapor condensate, or steam may be injected to the warmer side of an evaporator effect in order to increase the condensing temperature of the vapor. The volatiles are typically alcohols (methanol and/or ethanol) used as the cooking liquor in organic solvent pulping.

11 Claims, 1 Drawing Sheet

PROCESS FOR THE CONCENTRATION OF SPENT LIQUORS

BACKGROUND AND SUMMARY OF THE INVENTION

The present invention relates to a process for an integrated system for the evaporation of spent liquors and recovery of alcohols in cellulose pulping processes using cooking liquors based on alcohols or corresponding cooking liquors, e.g. organic solvent pulping. In such processes the cooking liquors contain alcohols as active substances, such as methanol, ethanol, or other liquids having a lower boiling point than water.

In cellulose solvent pulping processes, the chips are first steamed. A prehydrolizing step may then follow. The cooking is carried out in two stages. In the first stage, the chips are cooked with a solution of chemicals containing about half methanol and half water. The cooking is effected at a temperature of about 190° C. and takes from 20 to 50 minutes. In the second stage, caustic soda having a concentration of 18 to 22 percent is added. The temperature is maintained between 165° and 175° C., the second stage being practiced about 60 minutes.

After cooking, or partly integrated with the cooking stage, washing of the pulp begins. The purpose of the wash is to wash away from the pulp substances which have been dissolved during cooking, such as lignin, and initiate the recovery of cooking chemicals. The spent washing liquid contains methanol, partly deriving from the supplied cooking liquid, partly produced during the cooking. The percentage by weight of methanol is on the order of about 17 to 20 percent. The spent liquor also contains about 10 to 15 percent dry matter. The spent liquor is usually evaporated to a dry matter content of about 55 to 65 percent so that the liquor —also called thick liquor—can be combusted in a boiler and chemicals can be recovered from dissolved organic substances, recovering heat at the same time.

When the spent liquor arrives at the evaporator system, besides having a high temperature, it is also under a high pressure and contains volatile substances to such a degree that it is classified as being easily inflammable and explosive. All this renders intermediate storing of the spent liquor before and during the evaporation expensive and difficult. Storing must take place in a pressurized vessel, or the liquor must be cooled to a temperature lower than 50° C. before being stored.

According to the present invention, evaporation and the recovery of chemicals from spent solvent pulping liquor can be carried out so that no buffer container or intermediate storage is needed. When the spent liquor arrives at the evaporator system, which usually is a multistage evaporator, water is at first evaporated from the liquor and the content of volatiles is reduced by expansion in several steps, thereby making evaporation possible. A high content of volatiles, such as methanol, lowers the condensing temperature considerably and also impairs the heat transfer in other ways, which renders the conventional cascade evaporating method less economical. These problems have been solved by the present invention. The heat transfer can be improved when divided heat surfaces are used for evaporation, which makes ample venting and an early separation of volatiles possible. For that reason, intermediate storage of the spent liquor is not necessary. Heating condensation is carried out in each evaporator apparatus, at least before the final thickener, on several heat surfaces separated from each other. The heat surfaces in the evaporation effects can comprise tubes or plates.

A part of the heat surface in each evaporator effect can condense liquor vapor from the preceding effect, and a separate part of the heat surface in the same effect can condense expansion liquor vapor. The liquor vapor contains less volatiles than the expansion liquor vapor. As these vapors, according to the invention, are not mixed with each other prior to their use as heating medium in the next step, it is possible to utilize a higher condensing temperature in an efficient way. It is then also possible to treat condensates containing different amounts of volatiles separately.

Additional advantages are, according to the invention, obtained by injecting pure water, vapor condensate, or vapor (steam) at the warmer side of the evaporator in order to increase the condensing temperature, which in turn increases the available useful temperature difference. Addition of water to the vapor brings about a new condition of equilibrium between vapor and liquid, in which the concentration of volatiles, such as methanol, in the vapor, is lower and the condensing temperature of the vapor is higher. Water is preferably added to methanol-rich vapors, such as expansion liquor vapors, which are produced in expansion tanks before the evaporation units.

On the liquor side of the evaporation apparatus, the liquor is circulated up to distribution means—one or several—which are either common or divided for the divided heat surfaces, and the liquor vapor is evaporated in a vapor compartment which is not divided.

BRIEF DESCRIPTION OF THE DRAWINGS

The invention will now be described more in detail by way of an example with reference to the accompanying schematic drawings.

DETAILED DESCRIPTION OF THE DRAWINGS

Weak (spent) liquor in line 10 (see FIG. 1) from the cooking department of a cellulose pulp plant is evaporated in an evaporating plant 100 comprising several expansion tanks and three evaporator units 103, 102 and 101 (final thickener) connected in series. The evaporator units 102–103 are provided with heat exchange surfaces for heating and evaporation of liquor by means of a heating medium, shown schematically in FIG. 2. At least the vapor sides of these evaporator units 102–103 are divided such that two or more separate condensing compartments, each compartment containing tubes or plates, are formed. It is then possible to condense vapors containing different amounts of methanol separately.

Figure 1:
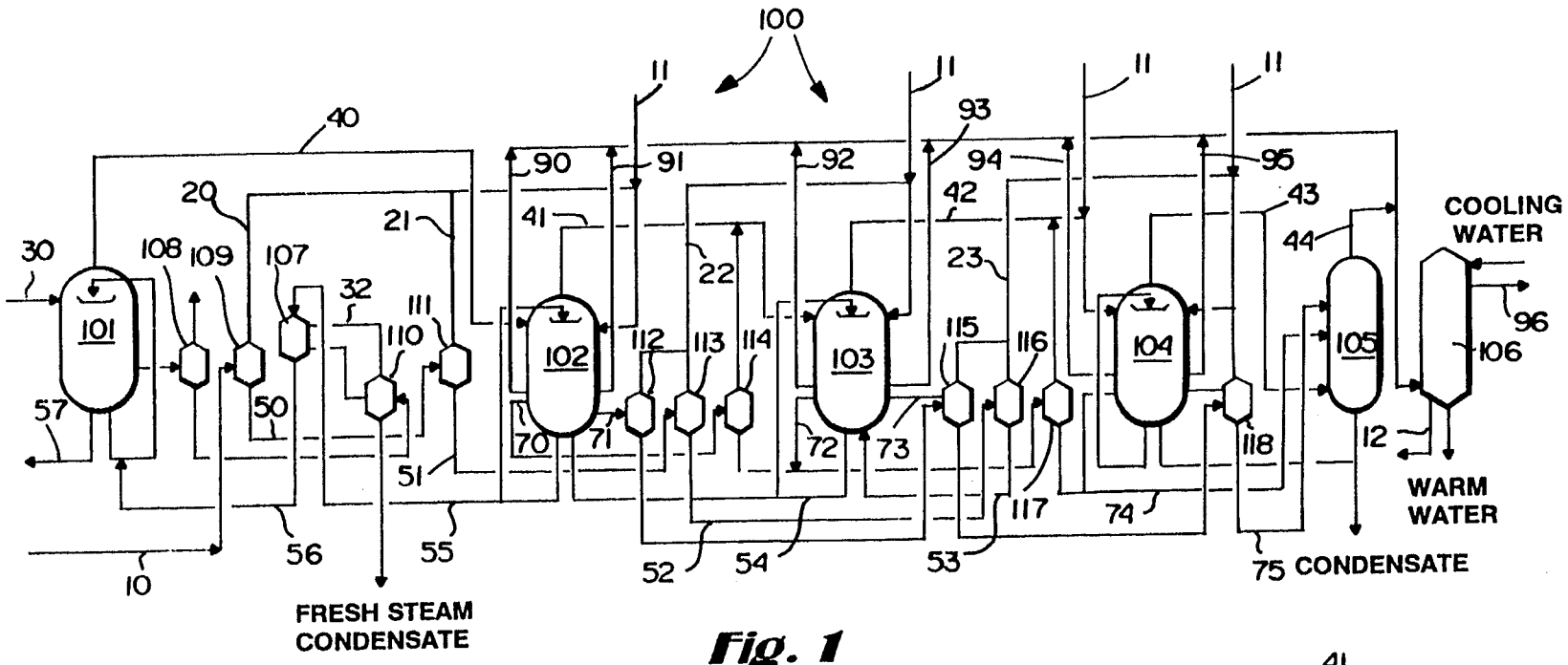
FIG. 1 is a schematic of exemplary apparatus according to the invention for practice of a method according to the invention.

The evaporating plant 100 shown in FIG. 1 operates according to the counter flow principle. The weak (spent) liquor 10 from organic solvent cooking is expanded to a lower pressure and temperature in the first expansion tanks 109, 111 such that the temperature of the liquor decreases close to the liquor temperature prevailing in the first effect 101.

The first effect, i.e. the final thickener, 101 is driven by fresh steam 30, and evaporated liquor vapor 40 from this effect drives a part of the second effect 102. The remaining part of the heat surface in effect 102 is driven by the expansion vapor 20, 21 from the first liquor expansion tanks 109, 111.

The liquor 50, 51 from the first expansion tanks 109, 111 is passed to the next expansion tank 113 and the expansion liquor vapor from tank 113 is condensed in the third effect 103 in a separate part of the heat surface. Another part of the heat surface of effect 103 condenses the vapor 41 from the second evaporator 102. A separate part of the heat surface in effect 103 can also be used for cooling of the fresh steam condensate.

From the second expansion tank 113, the liquor 52 is passed to a third expansion tank 116, and the third expansion vapor 23 is condensed in a part of the heat surface of a reboiler 104 which drives a methanol distillation column 105. The liquor vapor 42 and condensate expansion vapors from the preceding steps are condensed on a separate part of the heat surface in the reboiler 104. Condensate 70, 71, 72, 73 from the second and the third effects 102, 103 is expanded in expansion tanks 112, 114, 115, 117 and 118.

After expansion, the liquor 53 is passed from the expansion tank 116 to the third effect 103 and is circulated to distribution means 58 (see FIG. 2) which are either common or divided for the different heat surfaces. The vapor 42 evaporated from the liquor is withdrawn through the outlet of the apparatus 103. From the third effect 103, the liquor 54 is passed to the second effect 102 and from the second effect 102 through a preheater 107 to the final thickener 101.

The preheater 107 condenses expansion vapor 32 from fresh steam condensate which has expanded in expansion tanks 108 and 110. The preheater 107 can also condense liquor expansion vapor 20, in which case the heat economy of the system will improve. The preheater 107 improves the heat transfer in the first step by increasing the temperature of the liquor, before the final stage 101, which operates with the thickest and most viscous liquor.

The finally evaporated thick liquor 57 is withdrawn from the final thickener 101.

Water, vapor condensate, or steam 11 is injected into the vapors 20, 21, 22, 23, 42 in order to increase the condensing temperature.

A distillation column 105, in which the methanol content of the condensate is recovered by stripping, is integrated with the rest of the plant. The condensates 74 and 75 from the reboiler 104 are transported to column 105, to which vapor 43 from the reboiler 104 is supplied for stripping of methanol and other volatiles from the condensates. The distillation column 105 and the reboiler 104 are disposed between the last evaporator effect 103 and a surface condenser 106. This arrangement allows large amounts of pure vapor to be driven through the column 105, whereby methanol is recovered. Purified condensate, which is withdrawn from the bottom of the distillation column 105, can be used in the washing of the organic solvent produced cellulose pulp, and in the reboiler 104. In reboiler 104 it is vaporized and then passed to the distillation column 105.

The vapor 44 from the column 105, and vapors 90, 91, 92, 93, 94, 95 from the evaporator units 102 and 103 and the reboiler 104, all containing methanol, are condensed in the surface condenser 106 in order to recover methanol 12. A part of the heat surface of the surface condenser 106 cools gases 96, which leave the plant.

Figure 2:
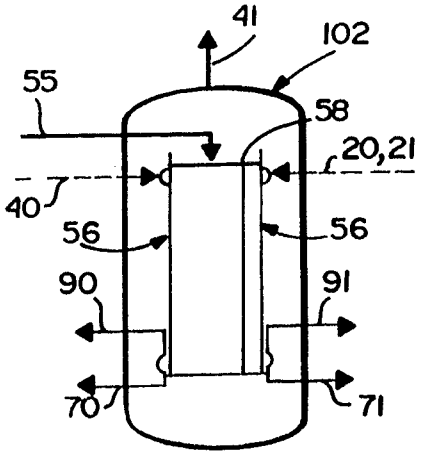
FIG. 2 is a schematic detail view of one of the evaporator effects of the apparatus of FIG. 1.

FIG. 2 is a more detailed schematic illustration of an evaporation effect, for example, 102. The evaporator 102 comprises two separate lamella units 56, each of them consisting of several lamellas. A single lamella consists of two joined heat transfer plates. Heating medium, i.e., vapor flows between these heat transfer plates and liquor 55, fed through common distribution means 58, flows on their outer surface. The distribution means 58 also could be divided. Each lamella unit 56 is provided with a vapor (i.e. 40, and 20, 21, in FIG. 2) of its own as a heating medium.

According to the present invention, final products of high quality can be economically recovered, which can all be used directly in the same mill as follows: methanol and/or ethanol in the cooking department, liquor vapor condensate in the washing department, and gases and thick liquor as fuel in the recovery boilers.

According to one aspect of the invention it will thus be seen that there is a method of evaporating spent liquor 10 from organic solvent pulping of cellulose pulp without intermediate storage thereof, using a series of evaporator effects 101–103, comprising the steps of: (a) Expanding the spent liquor in at least two stages (e.g. tanks 109, 111) to produce a liquor with a reduced content of volatiles, and with expansion vapors. (b) Feeding the liquor with reduced volatiles to the evaporator effects 101–103, to in turn increase the solids content of the liquor. And, (c) recovering organic solvent pulping liquor from the volatiles from step (a) (using 104–106, etc.).

According to another aspect of the invention, there is a method of evaporating spent cellulose pulping liquors, and recovery of volatiles from the spent liquors, using a plurality of series connected evaporator effects 102–103, each evaporator effect having divided heat exchange surfaces, including a vapor side and a liquor side, comprising the steps of: (a) Feeding spent cellulose pulping liquor (10) to the evaporator effects (101–103) so as to condense more than one vapor in each effect, on different heat exchange surfaces. And, (b) recovering the volatiles utilizing the condensate from each of the effects. Step (b) is practiced by reboiling the condensate (in 104), and then distilling it (in 105).

While the invention has been described and illustrated with reference to a particular exemplary embodiment thereof, it shall be understood that the invention is not limited to this precise embodiment, and that many modifications may be made thereof within the scope of the invention, which is defined in the appended claims.

What is claimed is:

1. A method of evaporating spent liquor from organic solvent pulping of cellulose pulp comprising the steps of:

(a) using a series of evaporator effects, each of the evaporator effects having a plurality of distinct surfaces, including a vapor side and a liquor side;

(b) expanding the spent liquor to produce a liquor with a reduced content of volatiles, and with volatile expansion vapors;

(c) feeding the liquor with reduced volatiles to the evaporator effects so that part of it is evaporated and the solids content of the liquor is increased;

(d) in a plurality of the evaporator effects, introducing more than one vapor separately to the distinct heat exchange surfaces to provide heat for heating the liquor to effect evaporation thereof, one of the vapors being a volatile expansion vapor from step (b), and another vapor being a separately introduced vapor from another effect, some of the introduced vapors condensing when heating the liquor, to produce condensates; and (e) recovering organic solvent pulping liquor from the volatile expansion vapor from step (b) and vapors from step (c).

2. A method as recited in claim 1 wherein step (e) is practiced utilizing at least one of the condensates from step (d).

3. A method as recited in claim 2 wherein step (d) is further practiced by the substep (i) of adding fluid to the vapor side of each effect to increase the condensing temperature of the introduced vapors.

4. A method as recited in claim 3 wherein the fluid added is selected from the group consisting of water, vapor condensate, and steam.

5. A method as recited in claim 2 wherein step (e) is practiced by expanding condensate, condensing it in a reboiler, and then distilling it.

6. A method as recited in claim 1 wherein the cellulose pulping liquor is a solvent pulping liquor consisting of ethanol, methanol, and mixtures of ethanol and methanol.

7. A method as recited in claim 1 comprising the further step (f) of evaporating the liquor from step (c) in a final thickener and utilizing the vapor generated by step (f) in step (d).

8. Apparatus for recovery of volatiles from spent cellulose pulping liquors, comprising:

a plurality of series connected evaporator effects having heating surfaces therein, a vapor side, and a liquor side, and a condensate outlet from each effect;

means for expanding the spent cellulose pulping liquors to produce a liquor with a reduced content of volatiles, and with volatile expansion vapors;

at least some of said evaporator effects having said heating surfaces which are divided so that a plurality of separate compartments are formed on the vapor side in the same effect;

means for supplying different heating vapors, including means for supplying a volatile expansion vapor from said expanding means, and another means for separately supplying vapor from another effect, into operative association with the vapor sides of said separate compartments in a plurality of said evaporator effects; and means connected to said condensate outlets for the separation and recovery of volatiles from condensate.

9. Apparatus as recited in claim 8 wherein said means for the separation and recovery of volatiles comprises a reboiler and a distillation column.

10. Apparatus as recited in claim 8 wherein a plurality of expansion tanks operatively connected to said evaporator effects.

11. Apparatus as recited in claim 8 further comprising means for adding a fluid to the vapor side of at least some effects to increase the condensing temperature of the vapor introduced into those effects.

* * * * *